United States Patent [19]

Foundoukos et al.

[11] 4,444,526

[45] Apr. 24, 1984

[54] SUBMERGED TUNNEL AND A METHOD OF AND MEANS FOR CONSTRUCTING A SUBMERGED TUNNEL

[75] Inventors: Dimitris Foundoukos, Kedron 24, Ekali, Athens, Greece; Anthony D. Blee, 4 Canonbury Pl., London, N. 1, England

[73] Assignees: Dimitris Foundoukos, Athens, Greece; Anthony David Blee, London, England

[21] Appl. No.: 239,211

[22] Filed: Mar. 2, 1981

[51] Int. Cl.[3] ..... E01G 4/04

[52] U.S. Cl. ..... 405/136; 405/132; 405/147; 405/158

[58] Field of Search ..... 405/136, 137, 141, 144, 405/149, 132, 158

[56] References Cited

U.S. PATENT DOCUMENTS

| | | | |
|---|---|---|---|
| 172,027 | 1/1876 | Jones | 405/147 X |
| 172,028 | 1/1876 | Jones | 405/136 |
| 311,656 | 2/1885 | Hall | 405/136 |
| 346,543 | 8/1886 | Hall et al. | 405/136 |
| 4,13,384 | 10/1889 | Beecher | 405/137 |
| 723,986 | 3/1903 | Carson | 405/136 |
| 748,809 | 1/1904 | Stone | 405/147 |
| 1,098,961 | 6/1914 | Mosher | 405/136 |
| 3,410,098 | 11/1968 | Winberg | 405/147 X |
| 3,561,223 | 2/1971 | Tabor | 405/144 |

*Primary Examiner*—Dennis L. Taylor

*Attorney, Agent, or Firm*—McCormick, Paulding & Huber

[57] ABSTRACT

A method of, and apparatus for, constructing a submerged tunnel in situ and a submerged tunnel formed thereby has an inverted arch formation to resist upward buoyancy thrust and a sealed chamber unit mounted on the tunnel and longitudinally displaceable along it for servicing the exterior of the tunnel. The tunnel is constructed in situ by progressively lengthening towards each other two tunnel sections 3, 3' which extend in cantilevered manner from opposed base foundations 1 and 2. Each tunnel section has mounted on the free end thereof of an outer chamber unit 13, 13' and an inner chamber unit 6, 6' within the latter of which the free end of the tunnel section is progressively formed and extended. As the tunnel sections are lengthened their associated chamber units are displaced longitudinally and sequentially to provide clearance for further lengthening, such displacement may be effected by hydraulic rams or mechanical rack and pinion devices. When the tunnel sections 3, 3' are sufficiently lengthened the outer chamber units 13, 13' dock and are sealed together at 28, 28' and a passage opened between those chamber units 13, 13'. The inner chamber units 6, 6' are removed from within the combined outer chamber units and a passage is opened between these latter units through which the tunnel sections are extended and connected together to form the continuous tubular tunnel. The submerged depth of the tunnel sections may be controlled during construction by winches and anchorages devices 25, 26 and 27.

22 Claims, 3 Drawing Figures

SUBMERGED TUNNEL AND A METHOD OF AND MEANS FOR CONSTRUCTING A SUBMERGED TUNNEL

DESCRIPTION

Figure 1:
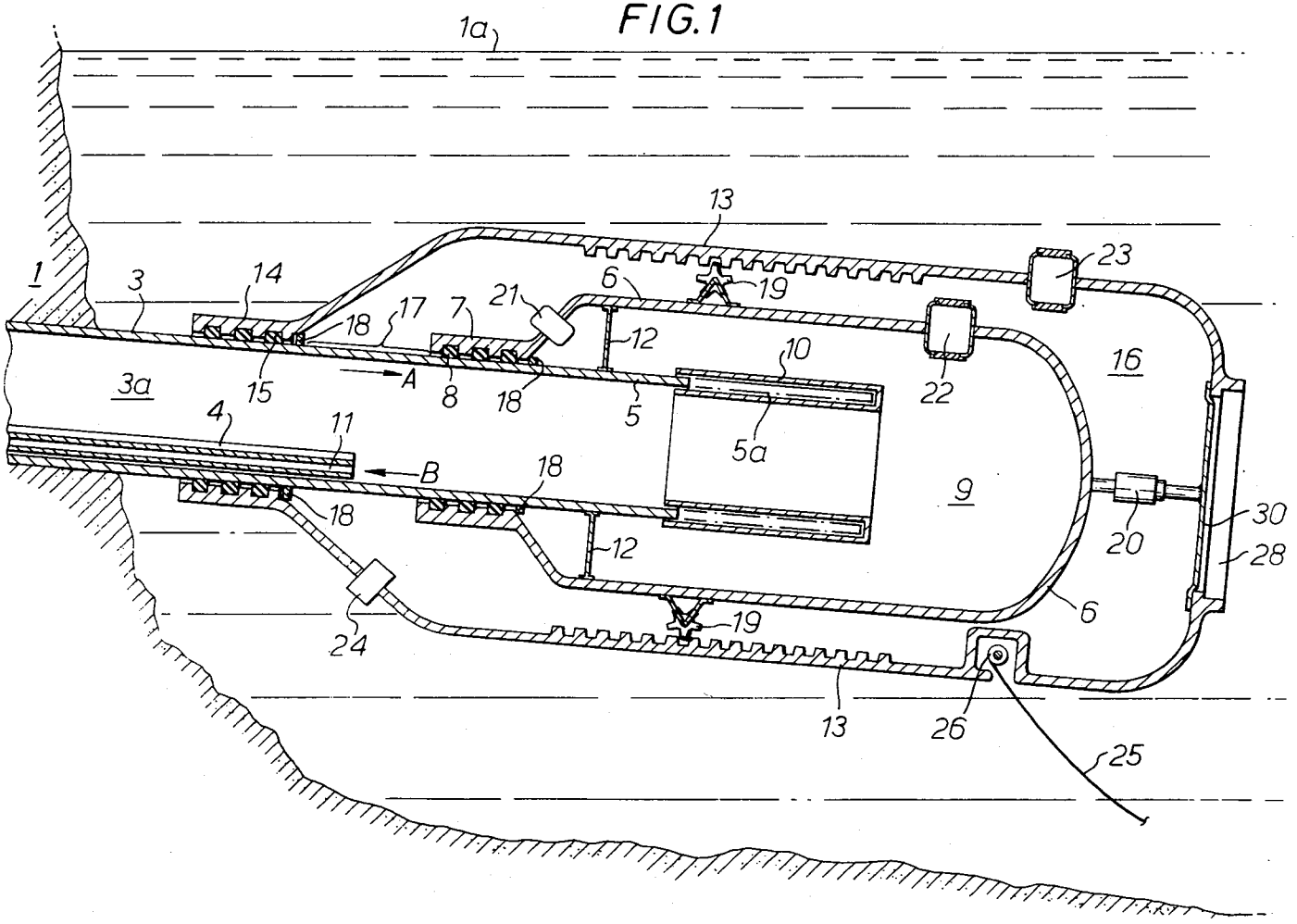

This invention relates to a method of, and means for constructing a submerged tunnel and also to a submerged tunnel.

Submerged tunnels extending between land bases are usually provided in conditions where a bridge is not possible (for example, if the span is too great, the land bases or sea bed are inadequate foundations or a shipping hazard would result) or where a bridge is undesirable (for example, aesthetically or environmentally).

Hitherto it has been the practice for submerged tunnels to be constructed on land and thereafter floated to the appropriate site and sunk into position; this technique besides requiring a large land based building site and heavy equipment for manoeuvring the tunnel or tunnel sections prior to their submergence is often disrupted by adverse weather conditions and interrupts shipping. It is an object of the present invention to provide a method and means of constructing a submerged tunnel in situ which alleviates the aforementioned disadvantages.

According to the present invention there is provided a method of constructing a submerged tunnel in situ which comprises providing a longitudinally extending substantially cantilevered tunnel section with a chamber unit mounted on the free end thereof so that the chamber unit and bore of the tunnel section provide a water sealed working chamber; lengthening the longitudinal extent of the tunnel section within the chamber unit, and displacing the chamber unit longitudinally relative to the tunnel section over the lengthened part thereof to permit further lengthening of the tunnel section within the chamber unit.

Further according to the present invention there is provided means for constructing a submerged tunnel in situ comprising a longitudinally extending substantially cantilevered tunnel section; a chamber unit mounted on the free end of the tunnel section so that that unit and the bore of the tunnel section provide a water sealed working chamber within which the longitudinal extent of the tunnel can be lengthened in the chamber unit, and means for displacing the chamber unit longitudinally relative to the tunnel section over the lengthened part thereof to permit further lengthening of the tunnel section within the chamber unit.

The present invention therefore envisages the construction of a submerged tunnel in situ by successively lengthening a cantilevered tunnel section which latter will usually be anchored in support foundations of a land base so that the bore of the tube is in direct communication with land throughout the construction of the tunnel. The construction, being effected in a submerged state, is unlikely to be affected to any great extent by adverse weather conditions and may be at such a depth as not to present a shipping hazard. The tunnel section being in the form of a tube will usually, but not necessarily, be of circular section and its lengthening within the chamber unit will usually be achieved by the addition of pre-formed elements to the end of the tunnel section or by progressively casting or moulding material to the end of the section. The present invention was primarily developed having in mind the construction of tunnels for the passage of vehicles therethrough in which case its dimensions will usually call for a basic tube structure of reinforced concrete although it will be appreciated that other materials for the tube can be utilised, say reinforced plastics sections for smaller tunnels which may be required for conduiting or a fluid flow passage.

The chamber unit effectively provides a pressure vessel within which work is carried out to progressively lengthen the tunnel section within that unit; this work may be effected both on the interior and the exterior of the tunnel section and when appropriate the pressure unit is displaced longitudinally over the newly lengthened tube wall to permit further lengthening.

Preferably two chamber units are mounted on the free end of the tunnel section, one such unit being located wholly within the other unit so that the inner chamber unit provides with the bore of the tunnel section a first working chamber and the outer chamber unit provides with the exterior of the inner unit a second working chamber within which there is access to the exterior of the tunnel section. By this arrangement the outer chamber unit effectively provides a second pressure vessel within the chamber of which further work may be carried out on the exterior of the tube section while the tunnel section is being progressively lengthened within the first working chamber. The inner and outer chamber units are displaced progressively along the tunnel section as the length thereof is increased. This displacement of the inner and outer chamber units may be effected simultaneously so that they move in combination but it is preferred that each chamber unit is displaceable relative to the tube section independently of the other so that when the outer chamber unit is stationary relative to the tube section the inner unit can be displaced longitudinally as the tube section is progressively lengthened to a maximum extent permitted by the outer unit and thereafter while the inner unit is stationary relative to the tube section the outer unit can be displaced over the inner unit to permit subsequent displacement of the inner unit.

As the length of the cantilevered tunnel progressively increases from its support foundation it will be apparent that the upward buoyancy thrust thereon increases and desirably the free end of the tunnel section is restrained at a desired depth of submergence by anchoring.

The whole construction of the tunnel may be effected by progressively lengthening the tunnel section from one land base to another and in such an event it is preferred that the shape of the tube which is formed is controlled, say by use of appropriate anchorages, so that the tube is an inverted arch to resist the upward buoyancy thrust thereon. It is realised however that on many occasions the construction of the tunnel from a single land base will be impractical or inefficient and it is preferred therefore that the construction is by means of two longitudinally extending substantially cantilevered tunnel sections each having a chamber unit mounted on its free end within which unit the lengthening of the longitudinal extent of the respective tunnel section is effected. A first of these tunnel sections is secured at a location corresponding to one end of the tunnel which is to be constructed while the second tunnel section is secured at a location corresponding to the other end of the tunnel which is to be constructed. The first and second tunnel sections are then progressively lengthened by working within their respective chamber units so that the free ends of the tunnel sections project towards each other and a condition is reached where the chamber units of the respective tunnel sections can be coupled together. With the chamber units coupled together a longitudinally extending water sealed passage can be formed between those units and thereafter one or both of the tunnel sections is lengthened to extend through the sealed passage and connect the two tunnel sections together to provide continuity of the tunnel. To resist the upward buoyancy thrust on the tunnel it is preferred that the tube is an inverted arch formation as aforementioned and generally the chamber unit of the first and second tunnel sections will be coupled together in the region of the centre of the arch mid-way between the land bases. Where each tunnel section has inner and outer chamber units mounted on the free end thereof, the two outer units can be coupled together to provide the water sealed passage therethrough while the two inner units can be dismantled or otherwise removed from the sealed passage prior to connecting the tunnel sections together. Alternatively the two inner chamber units can be retained within the sealed chamber of the outer units provided that their structure is appropriately modified to permit extension of the tunnel sections to form the continuous tunnel.

With the chamber units coupled together to provide the water sealed passage through which the tube of the tunnel extends a desirable feature can be provided by arranging for the chamber units to be longitudinally displaceable over the tube for the purpose of maintenance or servicing of the exterior of the tube. With this in mind the present invention still further provides a tunnel comprising a submerged tube extending between support foundations, said tube having the form of an inverted arch to resist upward buoyancy thrust thereon and there being mounted on the exterior of the tube a chamber unit providing with the exterior of the tube a water sealed working chamber and wherein said chamber unit is longitudinally displaceable along the tube for servicing the tube.

As will be appreciated appropriate water seals will be provided between the chamber unit or units and the tunnel section. Longitudinal displacement of a chamber unit will usually be effected by fluid pressure operated means such as hydraulic rams and/or mechanical means such as a rack and pinion device; displacement of a chamber unit may be effected by reaction directly between that unit and the tunnel section or, in the case of the inner and outer chamber unit proposal by reaction directly between the inner and outer units where one unit will be longitudinally displaced while the other unit is secured relative to the tunnel section. It is envisaged that the chamber unit or units will generally be displaced longitudinally without rotation relative to the tunnel section such as by use of appropriate sliding seals although alternative displacement means are available, for example the or a chamber unit may have an internal screw thread which mates with a complementary external screw thread provided on the tunnel section so that the chamber unit is displaced longitudinally by rotating it relative to the tunnel section.

Figure 2:
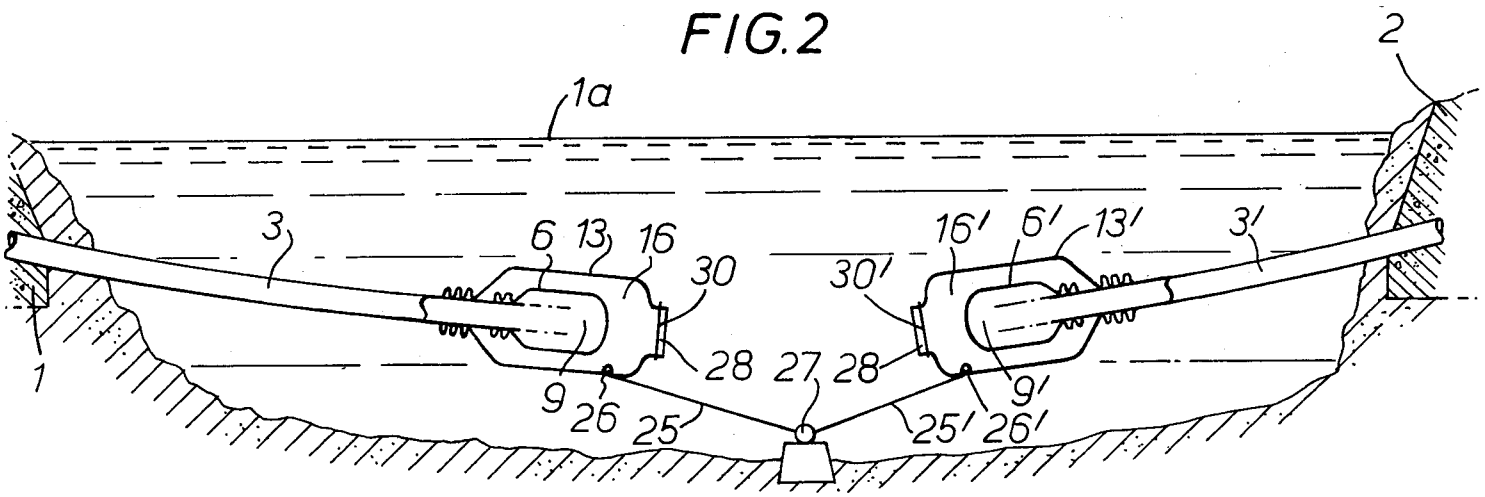
Figure 3:
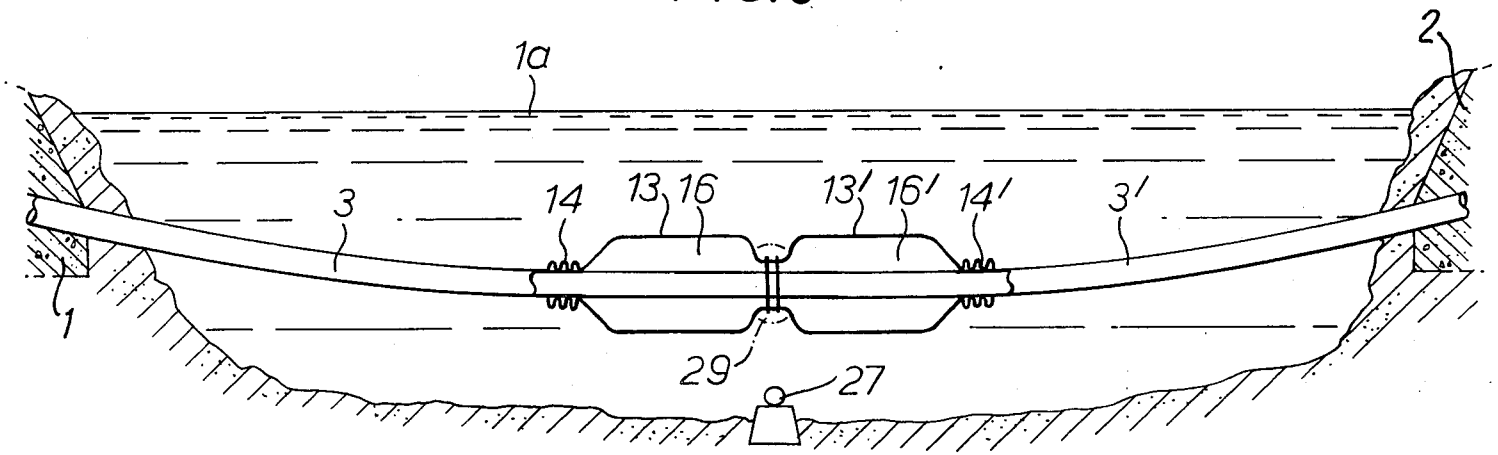

One embodiment of the present invention will now be described, by way of example only, with reference to the accompanying illustrative drawings, in which:

FIG. 1 diagrammatically illustrates a section through a cantilevered tunnel section and chamber units mounted on such section for the construction of a tunnel;

FIG. 2 diagrammatically illustrates an arrangement whereby two tunnel sections and associated chamber units similar to that shown in FIG. 1 are disposed for constructing a tunnel from opposed ends thereof, and FIG. 3 is a similar view to that shown in FIG. 2 and diagrammatically illustrates the tunnel when completed and having mounted thereon a chamber unit which is longitudinally displaceable along the tunnel for maintenance and inspection purposes.

The submerged tunnel is to be constructed between opposed land based support foundations 1 and 2. A generally cylindrical walled tunnel section 3 is secured in the foundation 1 so that the tunnel section projects from the foundation below water level 1*a* as a cantilever and the bore 3*a* of the tunnel section opens to atmosphere through the foundation. The completed tunnel may be intended for the passage of vehicles and may therefore include a road surface 4 or a railway and may be in the order of 12 meters diameter being constructed from reinforced concrete with internal water-proof membranes and textured external rendering. Mounted on the free end 5 of the tunnel section 3 is a bottle shaped chamber unit 6 having a neck part 7 within which the tunnel section 3 is received. Water seals 8 are provided between the neck part 7 and the tunnel section; the unit 6 is intended to be longitudinally displaceable along the tunnel section 3 and the seals 8 permit relative sliding movement and remain effective between the said two components during their relative longitudinal displacement. The chamber unit 6 forms with the bore 3*a* a working chamber 9 within which the free end of the tunnel section can be extended as indicated at 5*a*, for example by use of shuttering 10 where material is cast on to the existing free end of the tunnel section or by the addition of pre-cast elements to lengthen the tunnel section. The chamber 9 and bore 3*a* are substantially at atmospheric pressure and adequate ventilation can be achieved by circulating fresh air in the direction of arrow A from the land base while exhaust air can pass in the direction of arrow B through ducts 11 located beneath the road surface 4. To promote rapid curing of the material cast in the shuttering 10 the chamber 9 can be heated.

Following completion of the additional part 5*a* of the tunnel section (and removal of the shuttering 10) the chamber unit 6 is intended to be displaced longitudinally over the part 5*a* to permit sufficient working area in the chamber 9 for the free end of the tunnel section to be further and progressively lengthened. If required, spacers indicated at 12 can be provided between an enlarged diameter part of the unit 6 and the tunnel section 3 to maintain appropriate alignment between that section and unit.

Also mounted on the free end of the tunnel section 3 is a further bottle-shaped chamber unit 13 within which the chamber unit 6 is wholly received. The unit 13 similarly to the unit 6 has a mouth part 14 with internal water seals 15 within which the tunnel section 3 is received. Again similarly to the unit 6, the chamber unit 13 is intended to be longitudinally displaceable relative to the tunnel section 3 and this outer unit forms a second working chamber 16 which permits, in part, access to the exterior of the tunnel section 3 over the cylindrical region indicated at 17.

The chamber 16 being water sealed permits work to be carried out on the exterior of the tunnel section 3 over the cylindrical region 17 as aforementioned and both chamber units 6 and 13 provide effective pressure vessels which ensure adequate safety for the personnel in the chamber 9 and in the submerged length of the bore 3*a*.

The chamber units 6 and 13 are intended to be displaced longitudinally progressively and successively over the lengthened parts of the tunnel section 3. For this latter purpose, each chamber unit has associated therewith a clamping unit indicated at 18 by which the respective units can be selectively secured against longitudinal displacement relative to the tunnel section; the clamping units 18 may be operated by any convenient means such as mechanical, fluid pressure operated or electrical.

Relative longitudinal displacement between the units 6 and 13 is effected by rack and pinion units indicated at 19 operating in conjunction with hydraulic rams 20. As shown in FIG. 1, the driven components of the device 19 are mounted on the inner chamber unit 6 while the longitudinally extending racks with which the pinion components co-operate are mounted on the outer unit 13 and the rams 20 connect between the inner and outer units to provide a stroke which extends longitudinally thereof. If required spacer means (not shown) can be provided between the units 6 and 13 to maintain, or assist in maintaining, alignment between those units. With the outer unit 13 secured by clamp 18 to the tunnel section 3 the components in devices 19 can be driven and the rams 20 contracted to slidably displace the inner unit 6 rightwardly in FIG. 1 along the newly lengthened tunnel section until the maximum extent of displacement of the inner unit 6 rightwardly in the outer unit 13 is reached. At this latter stage the inner unit 6 can be secured by its associated clamp unit 18 to the tunnel section 3 and the clamp unit 18 associated with the outer unit 13 released; the pinion components of devices 19 can now be driven and the rams 20 extended to displace the outer chamber unit 13 along the tunnel section 3 and rightwardly in FIG. 1 to a desired extent whereafter the unit 13 can again be secured to the tunnel section 3 prior to rightward displacement of the inner chamber unit 6 as described above for further lengthening of the tunnel section.

As will be appreciated from the aforegoing all of the materials, equipment and facilities necessary for lengthening the tunnel section are fed into the working chamber 9 through the bore 3*a*.

Desirably the chamber 16 is maintained at a greater pressure than that in chamber 9 to relieve pressure on the seals 15 and for this purpose an air compressor 21 is provided. Air locks and de-compression chambers 22 and 23 are provided to permit access between the chamber 9 and the chamber 16 and between the chamber 16 and the water (the latter being convenient for external inspection). A water pump/sump 24 is provided in the outer chamber unit 13.

As the cantilevered length of the tunnel section 3 is progressively increased from the base foundation 1 the upward buoyancy thrust on the free end of the tunnel section (by which is included the buoyancy attributed to the chamber units) increases. To restrain upward movement of the free end of the tunnel section as a result of this buoyancy thrust the outer chamber unit 13 is anchored to the sea bed by a hawser 25 extending from a winch 26 (mounted in the unit 13) to an appropriate sea bed anchorage 27. As the outer chamber unit 13 is progressively displaced along the progressively lengthening tunnel section 23 the winch 26 can be operated to vary the length of the hawser 25 to maintain the free end of the tunnel section at a predetermined depth of submergence. As will be appreciated, several such anchoring devices can be provided.

If required, the tunnel section 3 can be lengthened and the chamber units 6 and 13 progressively displaced to extend that tunnel section from the base foundation 1 to the opposing foundation 2 while the submerged depth of the tunnel section is controlled by appropriate anchorages. Preferably however the tunnel is constructed by progressively lengthening (in a similar manner to that previously described) two similar tunnel sections extending in cantilevered manner from the base foundations 1 and 2 and at opposite ends of the effective tubular tunnel which is to be formed. This preference is illustrated in FIG. 2 where, for convenience, the same parts or members associated with with the second tunnel section as those associated with the first tunnel section 3 are indicated by dashed references having the same numerals. As the tunnel sections 3 and 3' are progressively lengthened towards each other their respective depth of submergence and alignment may be controlled by the winches 26 and 26' which, for convenience, are connected with the anchorage 27 (which is common to both winches) and may be situated beneath what will be the mid-length position of the tubular tunnel when completed. The tunnel sections 3 and 3' are extended until the outer chamber units 13 and 13' can conveniently be coupled together in alignment. To facilitate such coupling the chamber units are provided with mutually co-operable docking means 28, 28' which move into engagement with each other and can be welded, bolted or otherwise joined together as indicated at 29 in FIG. 3 to provide a water seal. Following the sealed connection of the two outer units, bulk heads (shown at 30 in FIG. 1) in the walls of those units are removed to provide a passage which extends longitudinally through the water sealed coupling 29 and within the enlarged chamber formed by the combined chambers 16 and 16'. The inner chamber units 6 and 6' are now dismantled and conveniently removed through the bore of the tunnel sections. One or both of the tunnel sections 3 and 3' is now lengthened to join with the other tunnel section within the enlarged chamber 16, 16' to complete the tubular tunnel as shown at 31 in FIG. 3.

From FIG. 3 it will be seen that the completed tunnel 31 is spaced from the sea bed and may be regarded as a "submerged floating tunnel". Furthermore, the tunnel 31 has the form of an inverted arch which resists the buoyancy thrust thereon and, if required, the anchorages 25, 25' can be removed.

Following completion of the tunnel 31 the coupled chamber units 13, 13' are preferably retained to provide the water sealed chamber 16, 16' and these units can be longitudinally displaceable over the length of the tunnel to permit servicing and maintenance of the exterior of the tunnel as and when necessary. Any convenient means can be provided for longitudinally displacing the combined units 13, 13' for example the units may be connected by hawsers to winches on the base foundations 1 and 2 which are controlled as necessary to move the units over the tunnel.

Usually the tunnel section or sections will extend between opposed land bases so that the tunnel lies in a single vertical plane and in plan view is substantially straight—this permits maximum advantage to be taken of the inverted arch form of the tunnel to withstand the buoyancy thrust. It is to be realised however that the present invention is applicable to the construction of a submerged tunnel which extends other than in a single vertical plane between opposed base foundations, that is to say the tunnel may be curved in plan view and although it may still have a substantially arch-like form in side elevation the curvature in plan view may require anchorages to resist the buoyancy thrust. Furthermore, to counter variations in upward buoyancy thrust that may occur on the tunnel section or sections during their lengthening as a result of the movement of heavy loads (such as material and equipment) along those sections, it may be desirable that the winch devices 26 provide self (automatic) levelling and/or that buoyancy tanks are incorporated within the tunnel sections or in the working chambers, such tanks being optionally water filled or air blown to vary the effective buoyancy of the tunnel sections as required.

We claim:

1. A method of constructing a submerged tunnel in situ which comprises providing a longitudinally extending substantially cantilevered tunnel section with two chamber units mounted on the free end thereof with one chamber unit located wholly within the other chamber unit so that the inner chamber unit and bore of the tunnel section provide a first working chamber and the outer chamber unit provides with the exterior of the inner unit a second working chamber within which there is access to the exterior of the tunnel section; lengthening the longitudinal extent of the tunnel section within the inner chamber unit, and displacing the inner and outer chamber units longitudinally relative to the tunnel section over the lengthened part thereof to permit further lengthening of the tunnel section within the chamber units.

2. A method as claimed in claim 1 which comprises providing a water seal between each chamber unit and the tunnel section.

3. A method as claimed in claim 1 which comprises maintaining a greater pressure in the second working chamber than that in the first working chamber.

4. A method as claimed in claim 1 which comprises maintaining the pressure in the first working chamber substantially at atmospheric pressure.

5. A method as claimed in claim 1 which comprises restraining the free end of the tunnel section in a submerged condition by anchoring.

6. A method as claimed in claim 1 which comprises forming the tunnel as an inverted arch to resist the upward buoyancy thrust thereon.

7. A method of constructing a submerged tunnel in situ which comprises providing two longitudinally extending substantially cantilevered tunnel sections, mounting two chamber units respectively one on each of the free ends of said tunnel sections and displacing said chamber units longitudinally relative to the respective tunnel sections on which they are mounted to permit lengthening of the longitudinal extent of the respective tunnel sections within the chember units, and which further comprises locating a first of the tunnel sections and its associated chamber unit at a location corresponding to one end of the tunnel which is to be constructed and locating the second of the tunnel sections and its associated chamber unit at a location corresponding to the other end of the tunnel which is to be constructed; lengthening the respective first and second tunnel sections towards each other until the chamber units of the respective tunnel sections can be coupled together; coupling the chamber units together; providing a longitudinally extending water sealed passage between the chamber units, and lengthening at least one of the tunnel sections to extend through the sealed passage to connect the two tunnel sections together and provide continuity of the tunnel.

8. A method as claimed in claim 7 which comprises mounting two chamber units on the free end of each tunnel section with one chamber unit located wholly within the other chamber unit for each tunnel section so that each inner chamber unit provides with the bore of its respective tunnel section a first working chamber and the outer chamber unit provides with the exterior of its associated inner unit a second working chamber within which there is access to the exterior of the respective tunnel section; lengthening the longitudinal extent of the tunnel sections within the respective inner chamber units, and displacing the inner and outer chamber units longitudinally with respect to the respective tunnel sections over the lengthened parts thereof, and which further comprises coupling together the two said outer chamber units; providing the longitudinally extending sealed passage between the outer chamber units; removing at least part of the two inner chamber units from the notional extent of the tunnel through the sealed passage and lengthening at least one of the tunnel sections to connect the first and second tunnel sections with each other.

9. A method as claimed in claim 8 which comprises wholly removing the two inner chamber units from within the outer chamber units prior to lengthening the first and second tunnel sections to connect with each other.

10. A method as claimed in claim 7 which comprises securing together the chamber units which form the sealed passage and mounting those chamber units on the tunnel sections so that they are longitudinally displaceable in combination along the exterior of the tunnel when constructed for servicing purposes.

11. Means for constructing a submerged tunnel in situ comprising a longitudinally extending substantially cantilevered tunnel section; two chamber units mounted on the free end of the tunnel section with one of the chamber units being located wholly within the other, the inner chamber unit providing with the bore of the tunnel section a first working chamber within which the longitudinal extent of the tunnel can be lengthened and the outer chamber unit providing with the exterior of the inner unit a second working chamber within which there is access to the exterior of the tunnel section, and means for displacing the inner and outer chamber units longitudinally with respect to the tunnel section over the lengthened part thereof to permit further lengthening of the tunnel section within the inner chamber unit.

12. Means as claimed in claim 11 in which the inner and outer chamber units are longitudinally displaceable relative to each other and to the tunnel section.

13. Means as claimed in claim 12 in which displacement of the inner and outer chamber units is effected by means which reacts between those units so that when one of the units is secured from longitudinal displacement relative to the tunnel section the other unit is displaceable longitudinally by reacting against the said secured unit and vice versa.

14. Means as claimed in claim 11 in which both the inner and outer chamber units are in water sealed engagement with the tunnel section.

15. Means as claimed in claim 11 in which means is provided for maintaining the pressure in the second working chamber greater than that in the first working chamber.

16. Means as claimed in claim 11 in which spacer means is provided between the inner and outer chamber units to maintain relative alignment between those units.

17. Means as claimed in claim 11 in which the chamber unit is substantially bottle-shaped having a neck portion within which the tunnel section is received and which neck portion is in water sealed engagement with the exterior of the tunnel section.

18. Means as claimed in claim 11 in which the chamber unit is longitudinally displaceable relative to the tunnel section by non-rotatable longitudinal sliding movement over the exterior of the tunnel section.

19. Means as claimed in claim 11 in which longitudinal displacement of the chamber unit is effected by at least one of fluid pressure operated ram means and co-operating rack and pinion means.

20. Means as claimed in claim 11 and comprising anchoring means for retaining the free end of the tunnel section at a desired submerged depth.

21. Means as claimed in claim 20 in which the anchoring means comprises a winch device carried by the chamber unit.

22. A tunnel comprising a submerged tube extending between support foundations, said tube having the form of an inverted arch to resist upward buoyancy thrust thereon and there being mounted on the exterior of the tube a chamber unit providing with the exterior of the tube a water sealed working chamber and wherein said chamber unit is longitudinally displaceable along the tube for servicing the tube.

* * * * *

UNITED STATES PATENT AND TRADEMARK OFFICE

CERTIFICATE OF CORRECTION

PATENT NO. : 4,444,526

DATED : April 24, 1984

INVENTOR(S) : Foundoukos, Blee and Sadler-Forster

It is certified that error appears in the above-identified patent and that said Letters Patent are hereby corrected as shown below:

Item [75] should read:

--DIMITRIS FOUNDOUKOS, Kedron 24, Ekali, Athens, Greece; ANTHONY D. BLEE, 4 Canonbury Pl., London, N.1, England and MICHAEL SADLER-FORSTER, 41 Lawford Road, N.W. 5, Great Britain--

Signed and Sealed this

*Eighteenth* Day of *September 1984*

[SEAL]

*Attest:*

GERALD J. MOSSINGHOFF

*Attesting Officer*

*Commissioner of Patents and Trademarks*